US006341713B1

(12) United States Patent
Kilmer

(10) Patent No.: US 6,341,713 B1
(45) Date of Patent: Jan. 29, 2002

(54) WASTE CONTAINER ENCLOSURE

(75) Inventor: Thomas K. Kilmer, Souderton, PA (US)

(73) Assignee: Sterlin Suma, Ltd., Souderton, PA (US)

( * ) Notice: Subject to any disclaimer, the term of this patent is extended or adjusted under 35 U.S.C. 154(b) by 0 days.

(21) Appl. No.: 09/633,797

(22) Filed: Aug. 7, 2000

(51) Int. Cl.[7] ..... B65F 1/14
(52) U.S. Cl. ..... 220/694; 220/730; 150/154
(58) Field of Search ..... 220/908, 694, 220/730, 376, 62.14; 150/154

(56) References Cited

U.S. PATENT DOCUMENTS

| | | | | | |
|---|---|---|---|---|---|
| 4,782,873 | A | * | 11/1988 | Messner et al. | 150/154 |
| 4,954,384 | A | * | 9/1990 | Hartwell | 428/100 |
| 5,165,567 | A | * | 11/1992 | Richardson et al. | 220/400 |
| 5,553,733 | A | * | 9/1996 | Rosenthal | 220/400 |
| 5,927,524 | A | * | 7/1999 | Miller | 215/11.6 |
| 6,036,047 | A | * | 3/2000 | Dobbie | 220/592.03 |
| 6,145,696 | A | * | 11/2000 | Duncan | 220/739 |

* cited by examiner

*Primary Examiner*—Stephen Castellano
(74) *Attorney, Agent, or Firm*—Volpe and Koenig, P.C.

(57) ABSTRACT

A covering assembly for waste containers and the like. The lid cover portion fits over the lid of the waste container. The body cover portion fits about and conceals the sides of the waste container which make up the body thereof with ends of the body member preferably overlapping one another and held securely in place by cooperating hook-type and loop-type fasteners, which, although being capable of being pealed apart, provide excellent shear strength. The lid and body cover portions are preferably made of the same material and are preferably the same color. The fabric has an aesthetically pleasing appearance and substantially completely covers the waste container whose appearance leaves something to be desired. The front surface of the body covering portion preferably has a pleasing graphic design together with a message, such as, "Welcome", "Kids Zone", "Merry Christmas", and the like. The main body portion is also provided with one of hook-type or loop-type fasteners which cooperate with complementary loop-type or hook-type fasteners provided on an apron member preferably arranged to cover message/design, region of the cover member to provide changing messages to accommodate seasons, holidays, as well as a variety of different message, for example. The lid and body cover members are formed of a suitable woven material which will not rot, crack or shrink even after long continued usage out of doors.

16 Claims, 6 Drawing Sheets

10
22'
28"
Welcome
29
29
30
Season's
Greeting
31
31
38"

WASTE CONTAINER ENCLOSURE

FIELD OF THE INVENTION

The present invention relates to coverings for containers, and more particularly, to aesthetically appealing covers for waste containers and the like providing covering for the containers and which conceal the mundane appearance of the containers and provides an aesthetically appealing appearance together with aesthetically pleasing graphics and a slogan or one of a variety of messages.

BACKGROUND OF THE INVENTION

Waste containers and the like, especially those employed in the waste industry and typically referred to as "universal carts" and/or "fully automated" or "semi automated" carts, are designed to accommodate a large quantity of waste and also designed to be automatically lifted so that their contents may be dumped directly into a refuse vehicle, often referred to as a "compactor" or "hopper". Due to their size and the amount of waste they may contain, these waste containers are usually wheeled to facilitate their movement from one location to another. Further, due to the amount of space that they occupy, these containers are typically stored out of doors and either immediately adjacent to or some short distance away from a house. These containers, although rugged and able to withstand the elements, detract from the otherwise aesthetic appearance of the property. Although the containers may be housed within the property, such as in a garage or a shed, it is a nuisance to have to continually put the refuse containers back in the garage and bring them out each time waste has to be deposited therein and each time the container is emptied by a collection crew. In addition due to their size, such waste containers prevent their storage in some garages when a car is stored therein. The unattractive appearance of the containers is compounded when two or more of the containers are required for the purpose of recycling, for example which requires that different forms of waste material be placed in different waste containers, such as individual waste containers being respectively provided for glass, papers and organic garbage.

It is thus desirable to provide some means by which the aesthetic appearance of a property is not detracted by unattractive waste containers, which are typically stored out of doors for convenience purposes.

BRIEF DESCRIPTION OF THE INVENTION

The present invention is characterized by comprising a cover assembly for waste containers and the like which cover assemblies comprise a lid cover and a body portion cover. The lid cover fits over a cover lid of the waste container, and is typically swingably mounted to the body portion thereof.

The body cover portion is an elongated sheet of a water-resistant, water-proof material, being of a color which coordinates well with the exterior of an urban home and blends nicely with residential landscaping.

One surface of the sheet is provided with an aesthetically appealing design and preferably includes a message or slogan, such as, "welcome", "home sweet home", "kid zone", and so forth.

The body cover member has a height which is coterminous with the height of the waste container. At present, this inventor has found that sheets of two different heights are satisfactory to accommodate 95% of the variety of sizes and designs of containers presently on the market. The inventor has found that heights don't change as capacity (per gallon) increases, only perimeter size/diameter.

The cover member wraps around the waste container and preferably has a width which is sufficient to assure that the ends of the cover member overlap one another. The cover member is preferably releaseably held onto the waste container by cooperating hook-type and loop-type fastening members, which, when pressed together, provide an adequate holding force, especially in the shear direction.

The cover is sufficiently versatile as to position the art work in alignment with any one of the four sides of the waste containers and is merely dependent upon the preference of the homeowner.

The cover and lid are easily removable and are preferably removed prior to the time of waste collection.

The surface of the cover member opposite that upon which the art work has preferably been silk screened has a water-proofing coating, preferably of urethane.

In order to provide a greater variety of art work, an "apron" is provided and is preferably of a height and width sufficient to cover the original silk screen art work or any other portion of the cover. The use of an apron enables the homeowner to select from a number of different forms of art work for a variety of different objectives, such as, for example, having a different apron with art work representing each of the four seasons of the year; art work showing the homeowners favorite sports team or cartoon character; art work, together with a slogan welcoming or honoring a particular season or occasion, such as, "Happy Easter", "Season's Greetings", "Memorial Day" and so forth, thereby enabling the homeowner to select from among a large variety of slogans and/or art work, which may be used in combination with the basic cover, thereby avoiding the need to have a different cover member for each desired art work and/or slogan which the homeowner may wish to display.

The aprons are preferably joined to the basic cover by cooperating hook-type and loop-type fasteners.

OBJECTS OF THE INVENTION

It is therefore one object of the present invention to provide a novel cover for waste containers and the like which provides an aesthetically appealing appearance and totally conceals the waste container, which is typically unsightly and detracts from the appearance of the surroundings in which the waste container is located.

Still another object of the present invention is to provide a novel cover for waste containers and the like which significantly improves the aesthetic appearance of the waste container and which further provides the homeowner with an opportunity to select from among a variety of different designs and/or slogans provided on the cover.

Still another object of the present invention is to provide a novel cover for waste containers and the like which significantly enhances the aesthetic appearance of the waste container, especially when kept outside of the home and further utilizing changeable aprons releaseably arranged upon the cover to enable a homeowner to select from a wide variety of art work and/or slogans to be displayed to convey the wishes and/or desires of the homeowner.

BRIEF DESCRIPTION OF THE DRAWINGS

The above as well as other objects of the present invention will become apparent when reading the accompanying description and drawings, in which.

DETAILED DESCRIPTION OF THE PREFERRED EMBODIMENT(S)

Figure 1:
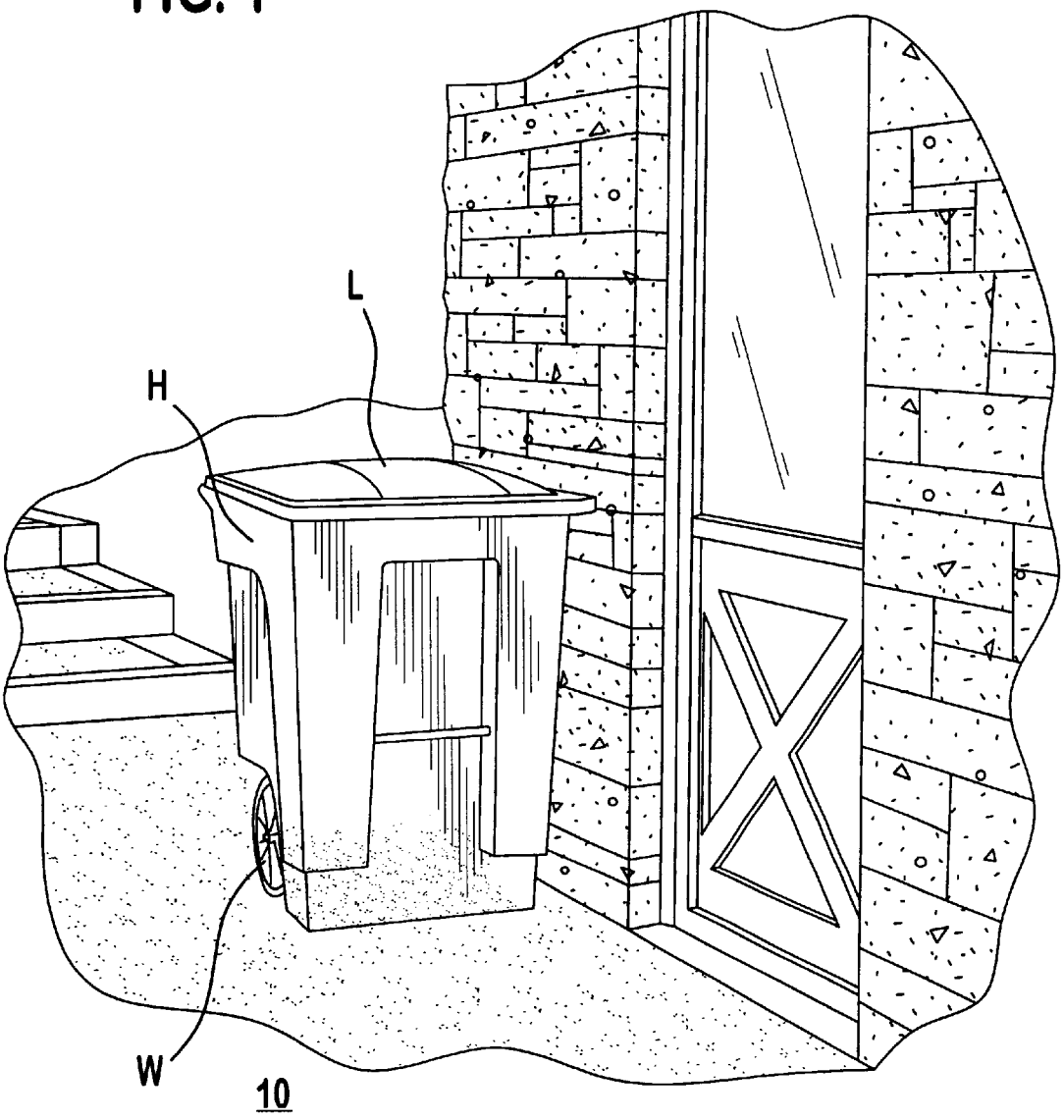
FIG. 1 is a perspective view showing a conventional waste container.

FIG. 1 shows a container C, typically referred to as a universal cart, having a pair of wheels W (only one of which is shown in FIG. 1—the other being hidden from view) to facilitate transportation of the waste container, especially when filled with waste material and comprises a hollow housing H covered with a lid, which is typically hingedly mounted along one top edge of housing H. Such containers are typically unsightly and detract from the aesthetic appearance of a residential setting.

Figure 2A:
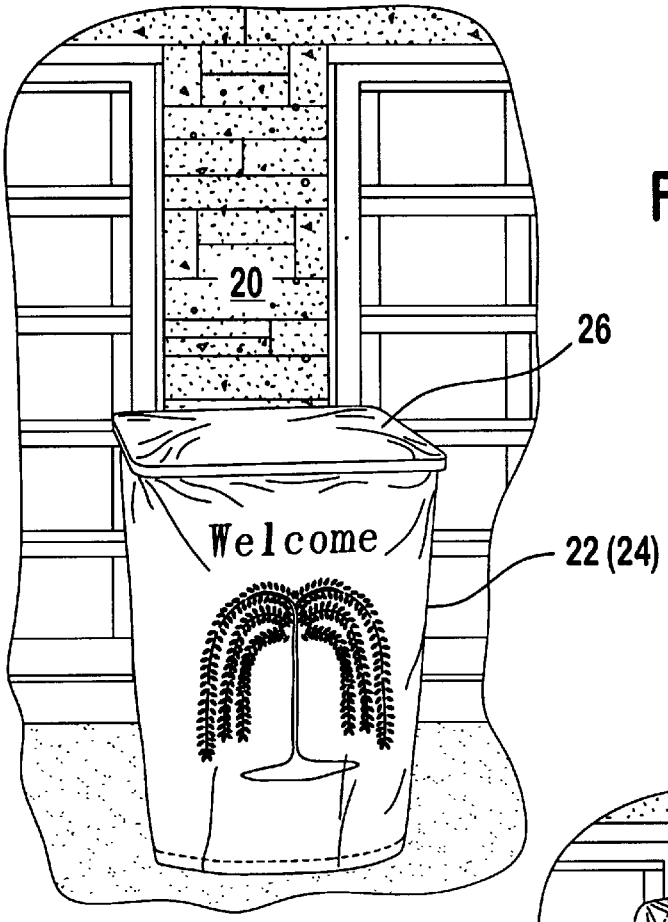
FIGS. 2*a* and 2*b* are perspective views showing a waste container of the type shown in FIG. 1 having the novel covering system of the present invention mounted thereon, FIG. 2*a* showing the container in the closed position and FIG. 2*b* showing the container with the lid open.

FIG. 2*a* is a perspective view of a container of the type shown in FIG. 1 covered with the cover members of the present invention, which can be seen to significantly enhance the aesthetic appearance of the waste container, especially when it is regularly placed in a location outside of the home or other residence.

The cover arrangement 20 shown in FIG. 2*a* can be better understood from a consideration of FIGS. 3*a* through 6.

Figure 4A:
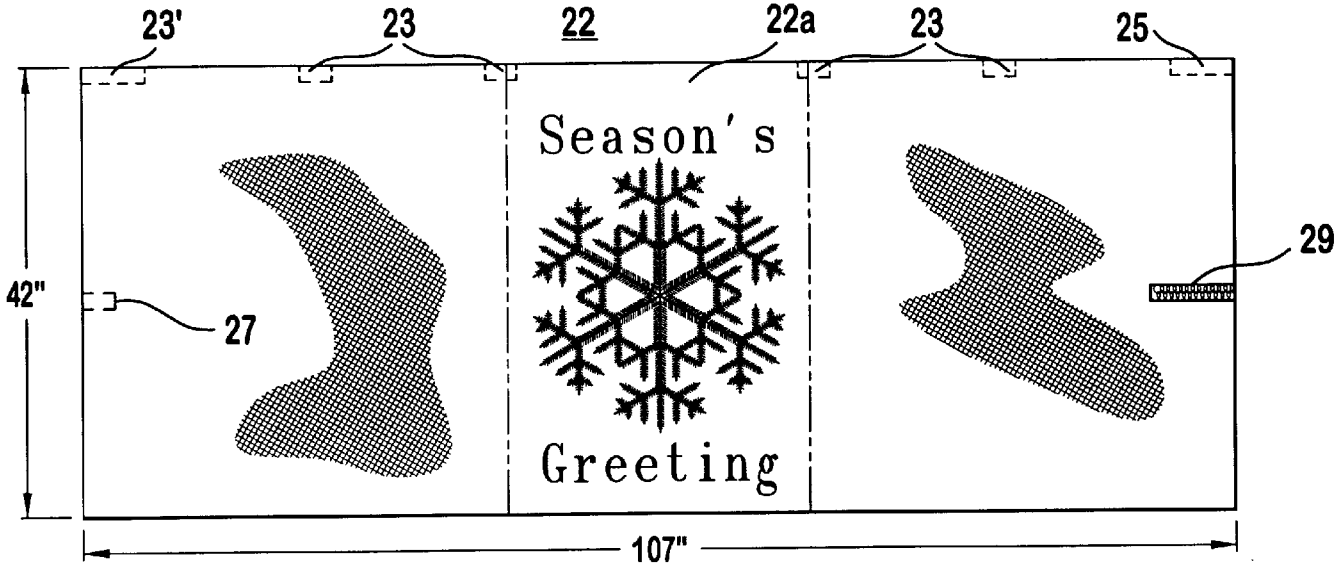
FIGS. 4*a* and 4*b* are plan views of cover members utilized to cover the main body portion of the waste container, shown, for example, in FIG. 1.
Figure 4B:
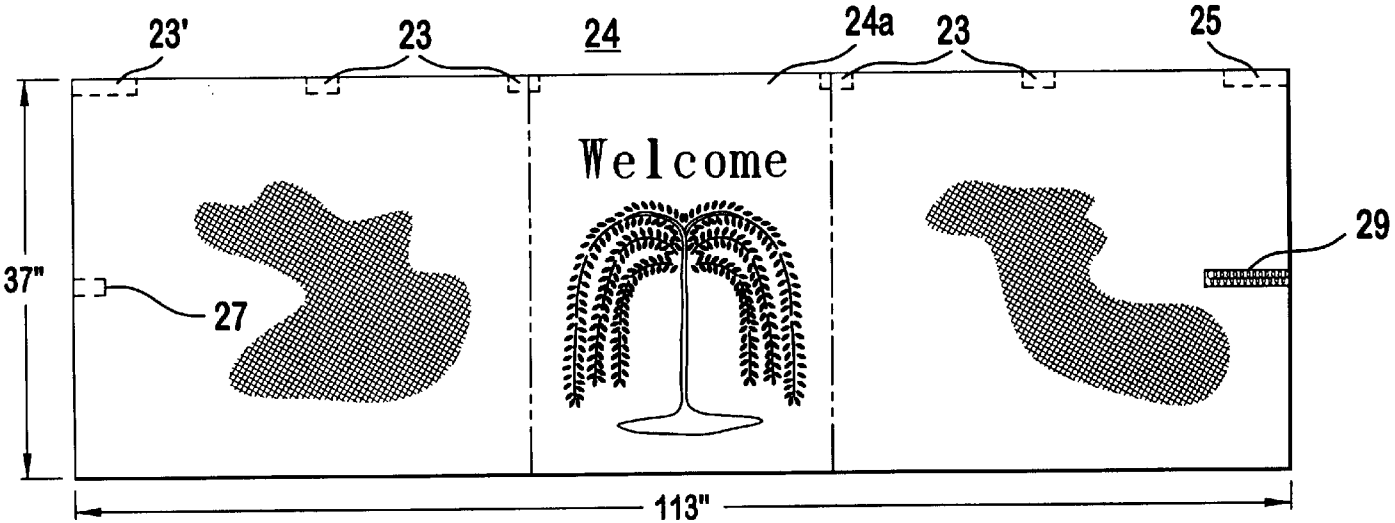

FIGS. 4*a* and 4*b* show a substantially rectangular-shaped cover sheet which differ from one another only in their dimensions. It has been found that a cover sheet 22, shown in FIG. 4*a* having a height of 42 inches and a width of 107 inches and a cover sheet 24, shown in FIG. 4*b*, having a height of 37 inches and a width of 113 inches, substantially accommodate better than 70% of the universal carts presently available in the market place.

Each cover sheet 22, 24, has a central region 22*a*, 24*a* which is silk screened to provide an aesthetically appealing design which is typically accompanied by a slogan or seasonal message, such as "Welcome", "Kids Zone", "Season's Greetings", "Happy Easter", etc.

Figure 2B:
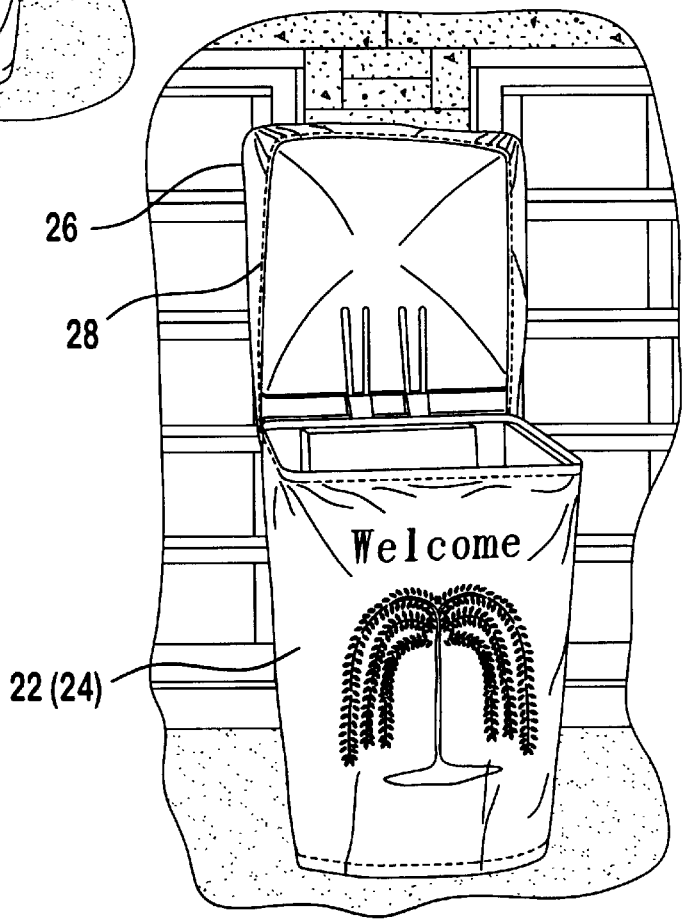

The cover members 22, 24 are provided with a number of hook-type and loop-type fasteners which cooperate with one another in order to secure the cover members to the waste container in the manner shown in FIGS. 2*a* and 2*b*. For example, the rear surfaces of the sheets 22, 24 may be provided along their upper edges with hook-type fastening members 23 and 23' along their upper edges. The cover members, together with the lid cover, to be more fully described hereinbelow, are packaged together with strips of loop-type fasteners with an adhesive backing covered by a protective cover, which is removed upon use so as to be adhesively adhered at locations along the top, outer surface of the waste container to cooperate with the hook-type fasteners 23. The loop-type fastener members are preferably arranged so as to be aligned with the hook-type fasteners 23. Such loop-type fasteners 27 are shown along the upper, outer surfaces of the waste container, shown in FIG. 6.

Hook-type fastener 23' cooperates with a loop-type fastener 25. Hook-type fastener 23' is secured to and arranged along the outer surface of each of the cover members 22, 24 so that when the left and right-hand ends of the respective cover members 22, 24 overlap one another, the loop-type fastener 25, which is arranged along the interior side, may be pressed into the hook-type fastener 23'. The fastener members 23' and 25 are preferably of a greater length than the fasteners 23 to assure that at least a portion of each will interengage the other cooperating fastener member to firmly secure the cover member in place.

Similarly, the fastener members 27 and 29 provided on cover members 22, 24, likewise, overlap one another in a manner similar to the fasteners 23' and 25 to provide additional fastening about mid-height of the cover members. If desired, additional members may be provided along the bottom edges of cover members 22 and 24. However, the number of cooperating fastening members, shown in FIGS. 4*a* and 4*b*, have been found to adequately retain the cover member in place on the waste container, in the manner shown in FIGS. 2*a* and 2*b*.

The lid member 26, shown in FIGS. 3*a* through 3*d*, is a universal size lid cover having a substantially rectangular-shape and being of the order of 29 inches on each side. An elongated elastic strip 28 is sown along the perimeter of the cover so that a marginal edge of the cover overlaps the elastic member and conceals it, the marginal edge being sown to the body of the lid. The strip 28 may alternatively be a plurality of shorter strips arranged about the cover perimeter.

The lid cover 26 stretches over a variety of sizes of container lids and in some cases over the top of the container body depending upon the design and size of the container.

Figure 3A:
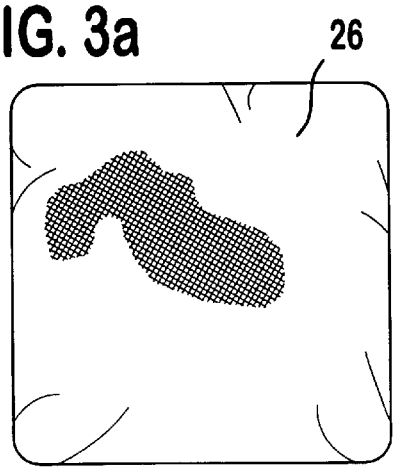
FIGS. 3*a* and 3*b* show top and side views of the cover shown in FIG. 2*a;*
Figure 3C:
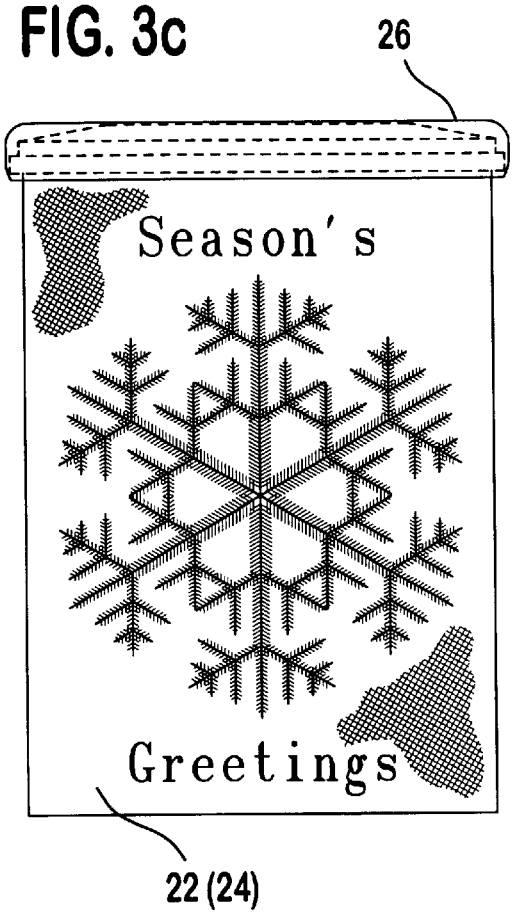
FIGS. 3*c* and 3*d* show front plan views of a lid cover provided on two different embodiments of waste containers.
Figure 3B:
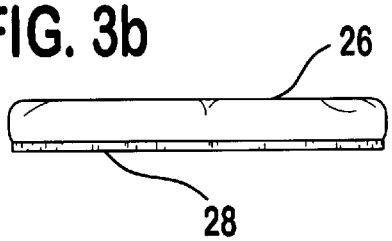

For example, noting FIG. 3*c*, in which the lid rests upon the top edge of the container, so that a lip surrounds the edge of the container lid, the lid cover may be stretched over top of the lip of the body of the container. The lid cover operates in much the same manner as an elastized shower cap, the elastic member being stretched when in use so as to assure a snug fit.

Figure 3D:
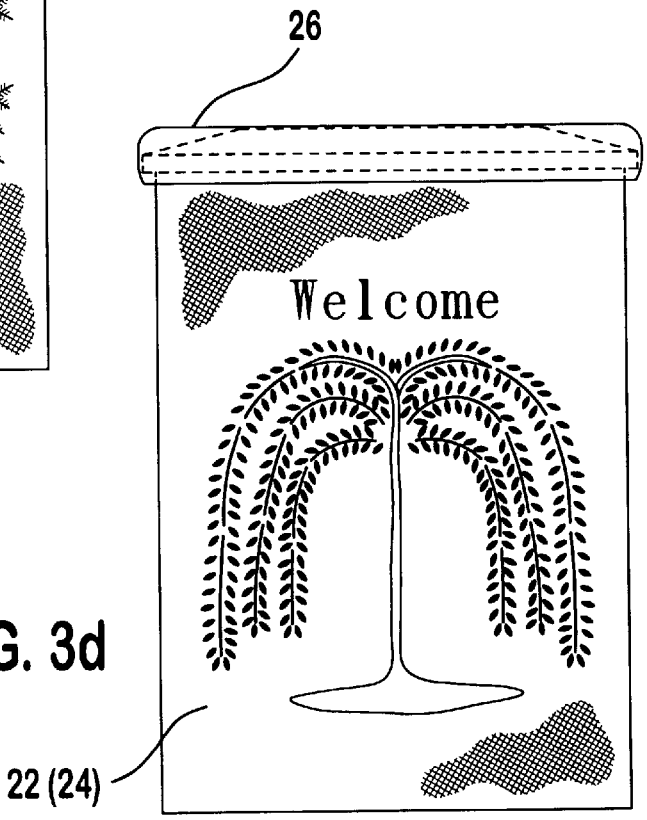

In the embodiment shown in FIG. 3*d* in which the lid of the waste container is designed so that the cover of the waste container has a lip which surrounds the upper edge of the body of the waste container, the lid cover is mounted only to the lid. This can also be seen from a consideration of FIG. 2*b* showing the lid in the open position and the lid cover 26 having the elasticized band portion 28 extending a small distance inward about the underside of the lid L.

The lid cover and body cover members 26 and 22, 24 are preferably formed of a material which is water-resistant and weather-proof. The interior surfaces of the members 22, 24 and 26 engaging the outer surface of the lid and waste container housing are preferably covered with a urethane layer which water-proofs the interior surface.

The members 22, 24 and 26 may be easily and readily removed in order to enable the waste contents of the universal cart to be dumped into the body or compactor of a waste collection truck (not shown), which is typically performed automatically, or least semiautomatically through the use of hydraulic lifters or arms which are installed on the waste collection truck and which are compatible with the lifting design and capacity of the universal carts. The use of this automated equipment is well known in the art since circa 1988. All of the major manufacturers of waste collection truck chassis; truck bodies and compactors make available automated lift equipment to the waste industry, including for example, Peterbilt, White, Volvo, Mack and Freightliner (truck chassis'); and Heil, McNeilus, Stagg, Wittke, STS and AMREP (truck body/compactors/and lifts). There are at least twenty (20) major brands of universal carts, and they include, for example, Schaeffer, Toter, Otto, Zarn, Rehig Pacific and Cascade.

In order to further enhance the cover member of the present invention and to enable homeowners to select from a wide variety of messages, designs and art work without requiring a full-size cover member for covering the body of the waste container, the main cover member is designed to have an apron mounted thereto.

Figure 5:
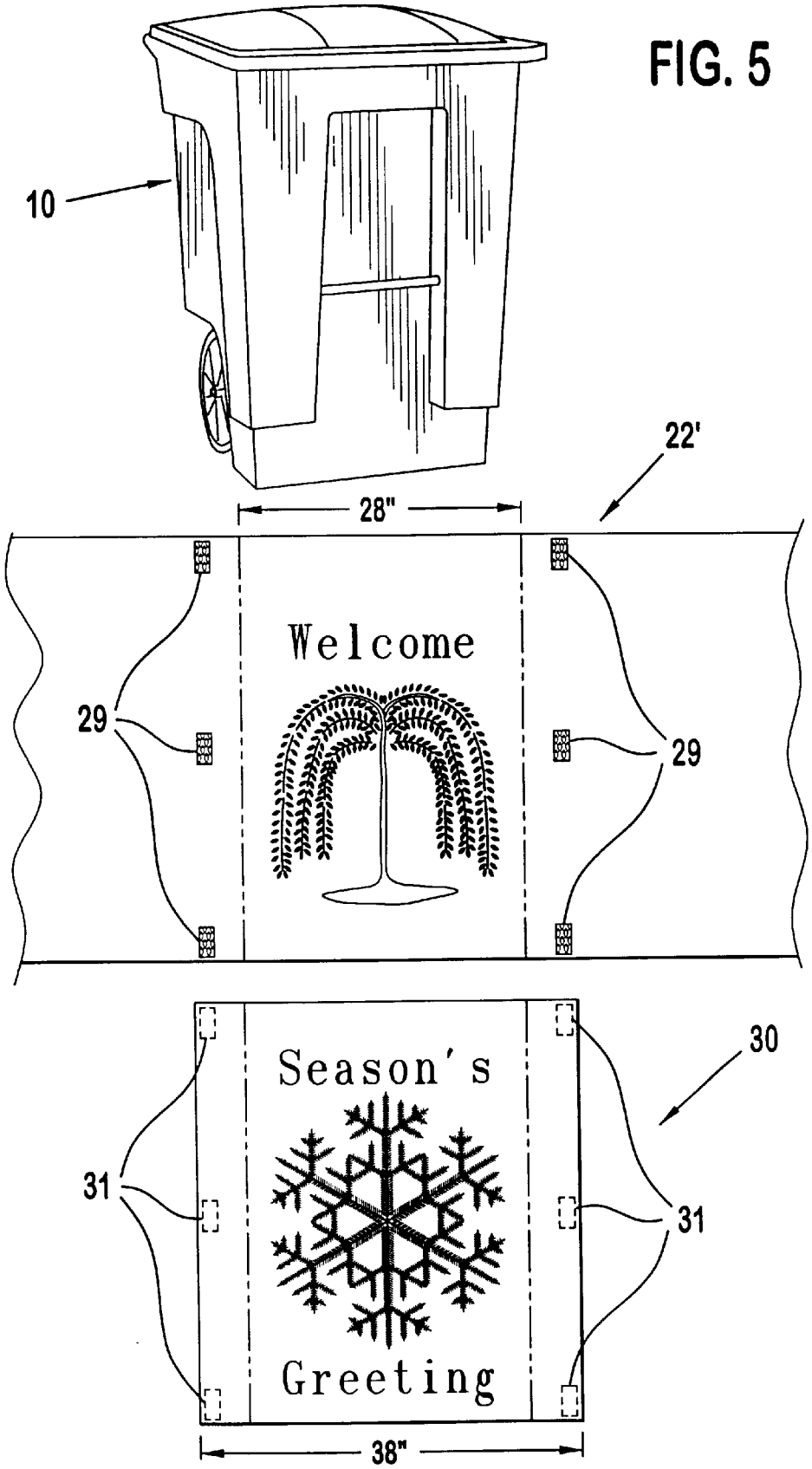
FIGS. 5 and 6 are exploded views of a container of the type shown in FIG. 1, a cover member of the type shown in FIG. 4*a*, for example, and an apron for releasable mounting thereon.
Figure 6:
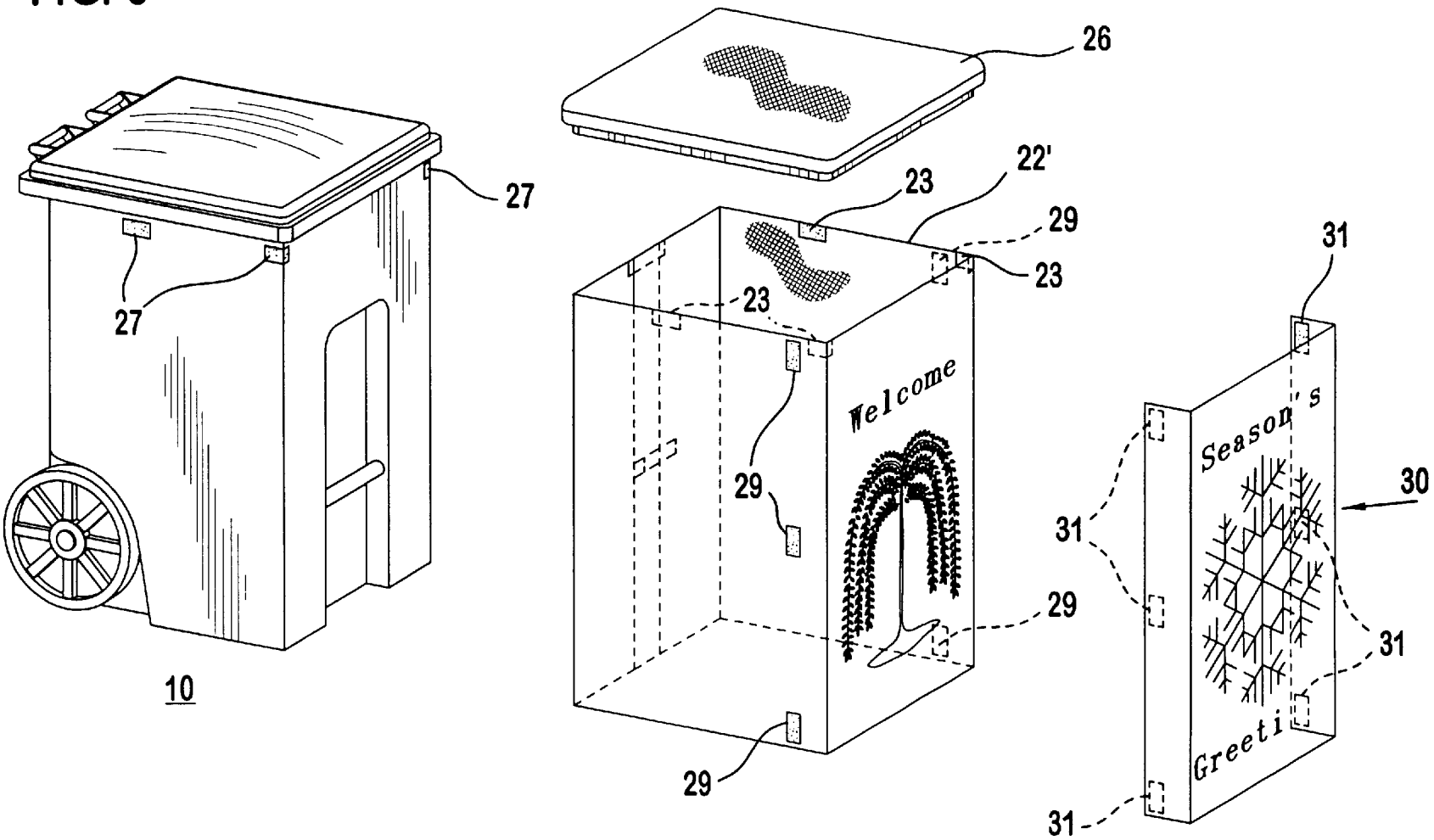

Making reference to FIGS. 5 and 6, the container 10 has mounted thereto a main body cover member 22' which is substantially the same as that shown in FIG. 4*a* with the addition of hook-type fasteners 29 arranged along the exterior surface of member 22' in order to facilitate the mounting of apron 30 which is provided with cooperating loop-type fasteners 31 arranged along the interior surface of skirt 30.

Apron 30 is positioned over the cover member 22' in order to substantially align the loop-type members 31 with the hook-type members 29 provided on cover 22', which members are then pressed together to secure and retain the skirt 30 upon the cover 22' and hence the art work as the cover member. This arrangement enables the homeowner to pick and choose from among a large variety of different aprons each having a different message, design, art work, etc., without the need for a full size cover member.

For example, the cover member 22' may have the art work and message shown in FIGS. 2*a* and 2*b*. The homeowner may desire to have a different apron representative of each season of the year together with appropriate art work associated therewith. For example, an apron depicting spring can present colorful flowers; an apron representing summer can present a beach scene; an apron representing the fall season can present leaves having typical fall coloring, and so forth. The aprons may be any one of a variety of different colors, design, slogans and art work enabling a variety of different messages or designs to be presented without the necessity for purchasing a large cover or removing the cover to select and display a different art work.

The covers 22, 24 and lid 26, as well as the aprons, are selected to be of a color which favorably coordinates with the natural landscape, such as a deep green, i.e., forest green. However, any other color may be utilized depending upon the needs and/or preferences of the homeowner. The covers withstand long periods of outdoor use and are easily removed and replaced when necessary and significantly enhance the environment in which they are placed by providing colors and art work which not only beautify the surroundings, but serve to completely conceal the container upon which they are mounted, which container, when uncovered, significantly detracts from the natural beauty of the surroundings in which it is placed. It should be understood that the hook type and loop type fasteners may be reversed from the positions shown in FIGS. 3–6.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. In combination, a waste container and a cover assembly concealing and beautifying the waste container comprising:

said container having a hollow body, a closed bottom, an outer side surface, and an open top selectively covered with a lid; and said cover assembly having a cover member, said cover member having a substantially rectangular cover sheet of a height substantially equal to a height of the container and a width sufficient to enable the sheet to cover substantially the entire outer side surface of the container body, said cover member being releaseably secured to said body by means of cooperating hook-type and loop-type fasteners respectively mounted on said cover member and the outer surface of said container body and being co-aligned and pressed together to retain the cover member on said container body, said cover member being of a color which blends harmoniously with an outdoor setting.

2. The combination waste container and cover assembly of claim 1, wherein said cover member is green.

3. The combination waste container and cover assembly of claim 2, wherein said cover member is forest green.

4. The combination waste container and cover assembly of claim 1, wherein said cover member is formed of a flexible, fabric-like sheet.

5. The combination waste container and cover assembly of claim 4, wherein said fabric-like sheet has a waterproof coating on a surface of said fabric-like sheet engaging the outer surface of the container.

6. The combination waste container and cover assembly of claim 1, wherein said cover member is provided with an aesthetically pleasing graphic design on the surface of said sheet which is exposed when the cover member is mounted upon the container.

7. The combination waste container and cover assembly of claim 1, wherein said cover member is provided with an aesthetically pleasing graphic design and a word message on the surface of said sheet which is exposed when the cover member is mounted upon the container.

8. The combination waste container and cover assembly of claim 1, wherein the width of the cover sheet is sufficient to substantially fully cover the outer sidewall surface of the container and so that the ends of opposite sides of the cover sheet overlap one another; and loop-type and hook-type fasteners being respectively mounted on an exterior surface of one of said ends and an interior surface of another one of said ends so as to be aligned with one another and, when pressed together to releaseably retain said ends to one another.

9. The combination waste container and cover assembly according to claim 1, further including an apron comprised of a sheet having a width which is less than a width of said sheet of said cover member so as to cover only a portion of said cover member;

cooperating hook-type and loop-type fasteners being respectively mounted upon an exterior surface of said cover member and an interior surface of said apron and being pressed together when aligned to releaseably secure the apron to the cover member; and an exterior surface of said apron having an aesthetically pleasing design on an exterior surface of said apron so as to be exposed to view when said apron is mounted upon said cover sheet.

10. The combination waste container and cover assembly according to claim 1, further including an apron comprised of a sheet having a width which is less than a width of said sheet of said cover member so as to cover only a portion of said cover member;

cooperating hook-type and loop-type fasteners being respectively mounted upon an exterior surface of said cover member and an interior surface of said apron so as to be pressed together when aligned to releaseably secure the apron to the cover member;

an exterior surface of said apron having an aesthetically pleasing design and a word message on an exterior surface of said apron so as to be exposed to view when said apron is mounted upon said cover sheet.

11. The combination waste container and cover assembly according to claim 1, further including an apron comprised of a sheet having a width which is less than a width of said sheet of said cover member so as to cover only a portion of said cover member;

cooperating hook-type and loop-type fasteners being respectively mounted upon an exterior surface of said cover member and an interior surface of said apron and pressed together when aligned to releaseably secure the apron to the cover member; and an exterior surface of said apron having an aesthetically pleasing design and a word message.

12. The combination waste container and cover assembly according to claim 1, further including an apron comprised of a sheet having a width which is less than a width of said sheet of said cover member so as to cover only a portion of said cover member;

cooperating hook-type and loop-type fasteners being respectively mounted upon an exterior surface of said cover member and an interior surface of said apron and being pressed together when aligned to releaseably secure the apron to the cover member; and an exterior surface of said apron having an aesthetically pleasing design on an exterior surface of said apron and being exposed to view when said apron is mounted upon said cover sheet, said apron substantially covering the aesthetically pleasing design provided on said cover sheet.

13. The combination waste container and cover assembly as set forth in claim 1, further comprising a lid cover for covering said container lid, said lid cover having a stretchable elastic member about its perimeter for securing said lid cover upon said container lid;

said lid cover being of a material and a color which coordinates with the color of said cover sheet.

14. The combination waste container and cover assembly of claim 13, wherein said lid cover and said cover sheet are both of the same color.

15. The combination waste container and cover assembly of claim 1, wherein the fasteners are sewn onto the cover member.

16. The combination waste container and cover assembly of claim 1, wherein the fasteners are adhesively secured to the exterior surface to the exterior surface of said waste container.

* * * * *